United States Patent [19]

Borom

[11] 4,102,689

[45] Jul. 25, 1978

[54] MAGNESIA DOPED ALUMINA CORE MATERIAL

[75] Inventor: Marcus P. Borom, Schenectady, N.Y.

[73] Assignee: General Electric Company, Schenectady, N.Y.

[21] Appl. No.: 775,762

[22] Filed: Mar. 9, 1977

[51] Int. Cl.[2] ..... B22C 9/10; B22D 21/00; B28B 7/34; C04B 35/44

[52] U.S. Cl. ..... 106/38.9; 106/62; 106/73.4; 164/41; 164/132

[58] Field of Search ..... 106/62, 73.4, 65, 38.9; 164/132, 369, 41

[56] References Cited

U.S. PATENT DOCUMENTS

| | | | |
|---|---|---|---|
| 3,643,728 | 2/1972 | Hulse | 164/132 |
| 3,725,094 | 4/1973 | Levy et al. | 106/62 |
| 4,031,177 | 6/1977 | Auriol et al. | 106/65 |
| 4,043,377 | 8/1977 | Mazdiyasni | 164/41 |

FOREIGN PATENT DOCUMENTS

| | | | |
|---|---|---|---|
| 618,248 | 2/1949 | United Kingdom | 106/62 |

OTHER PUBLICATIONS

Bailey, J. T. et al. "Preparation and Properties of Dense Spinel Ceramics in the Mg $Aw_2O_4$–$Aw_2O_3$ System"–Trans. Brit. Cer. Soc. 68(4), pp. 159–164, (1969).

Fritsche, E. T. et al. "Liquidus in the Alumina-Rich System $La_2O_3$–$Aw_2O_3$", J. Am. Cer. Soc. 50(3) pp. 167–168 (1967).

*Primary Examiner*—Helen M. McCarthy

*Attorney, Agent, or Firm*—D. M. Winegar; J. T. Cohen; M. Snyder

[57] ABSTRACT

Alumina doped with from 1 mole percent up to about 20 mole percent magnesia is suitable for use as a core material for casting and directional solidification of advanced super-alloys. The core material is leachable in KOH and NaOH in an autoclave at an elevated temperature and elevated pressure.

4 Claims, No Drawings

MAGNESIA DOPED ALUMINA CORE MATERIAL

BACKGROUND OF THE INVENTION

1. Field of the Invention

This invention relates to a ceramic material suitable for use in the casting and directional solidification of advanced superalloys.

2. Description of the Prior Art

The directional solidification of advanced superalloys, such as the eutectic superalloy NiTaC-13, requires casting times and temperatures beyond the capability of conventional silica based molds and cores. New mold and core materials must meet the basic criteria of chemical inertness to the molten alloy. The core, in addition to being chemically inert to the molten alloy, must also be capable of being easily removed from the casting by a method which does not adversely affect the engineering properties of the metal.

It is therefore an object of this invention to provide a material composition which is suitable for use as a core material in the casting and directional solidification of advanced superalloy material.

Another object of this invention is to provide a magnesia doped alumina material suitable for use in making cores for casting and directional solidification of advanced superalloys and which can be removed from the casting by a leaching process.

Other objects of this invention will, in part, be obvious and will, in part, appear hereinafter.

BRIEF DESCRIPTION OF THE INVENTION

In accordance with the teachings of this invention there is provided a ceramic material suitable for making cores for use in casting and the directional solidification of advanced superalloys. The core is made of a material which contains magnesia doped alumina. The magnesia content is greater than about 1 mole percent but less than about 20 mole percent. Preferably, the magnesia content is about 5 mole percent.

The core material is characterized by a microstructure which consists of an interconnecting network of magnesia doped alumina defining a plurality of interstices. Particles of magnesium aluminate spinel are deposited in the interstices.

The core is easily removed from the casting by an autoclave leaching process employing either KOH or NaOH leaching solutions. The leaching solution attacks the interconnecting alumina network and washes the remainder of undissolved material out of the casting by agitation of the solution and the ongoing chemical reaction.

Advanced superalloys, such as NiTaC-13, are not attacked by the core material or the leaching solutions.

DESCRIPTION OF THE INVENTION

It has been discovered that magnesia doped alumina doped with at least about 1 mole percent magnesia will leach in an autoclave KOH or NaOH solution at rates orders of magnitude greater than that for pure alumina of the same microstructure characterized by the degree of porosity. It is believed that the addition of the divalent alkaline earth cations into the trivalent cation lattice of $Al_2O_3$ introduces lattice defects which enhance the kinetics of the dissolution of alumina.

The magnesia may be present in amounts from about 1 mole percent up to about 30 mole percent. It has been discovered that as the magnesia content decreases, the volume fraction of the magnesia doped alumina phase increases. The magnesia doped alumina phase encases the spinel phase. The spinel phase therefore provides either an interconnected network defining a plurality of interstices in which the magnesia doped phase is found or a dispersion of particles within a matrix of magnesia doped alumina.

When a casting has solidified, the core of magnesia doped alumina is removed by autoclave leaching employing either a KOH or a NaOH solution. A solution of from about 10 weight percent in water up to about 70 weight percent in water has been found to be satisfactory. The autoclave temperature is preferably greater than about 200° C and may range upwards to about 350° C and higher. An elevated temperature of about 290° C is most often practiced. The elevated pressure in the autoclave results from the vapor pressure produced by the chemical reaction occurring therein. Autoclave leaching with a NaOH is preferred.

The NaOH or KOH leaching agent attacks the core by dissolving the magnesia doped alumina of the interconnecting network. The rest of the core material, spinel and any magnesia doped alumina remaining is physically washed out of the core cavity by agitation during the leaching process. Examination of superalloys, such as NiTaC-13, cast with the magnesia doped alumina core indicates no apparent attack on the material.

As the magnesia content decreases to about 5 mole percent, the leaching action increases to a maximum and thereafter decreases. The lower magnesia content has been found to be about 1 mole percent. Below this magnesia content limit, leaching times become too long to be commercially important for cores or specimens having less than 20 percent porosity, where the porosity is not interconnected.

Above about 20 mole percent magnesia, the leaching times again become excessively long so as to preclude possible commercialization at this time. Examination of samples indicate that the magnesia doped alumina network, when magnesia exceeds about 20 mole percent, begins to become discontinuous. Dissolution of the alumina network by the autoclave KOH or NaOH process therefore begins to fall off rapidly. The decrease in dissolution is attributed to the fact that autoclave leaching must occur by intergranular attack which at a magnesia content of about 25 mole percent is almost an order of magnitude slower than at a 20 mole percent content.

The magnesia doped cores may be prepared in either one of two possible procedures. In one procedure a mechanical mix of magnesia and alumina is prepared. The core is then formed by pressing and sintering at a temperature of from about 1,600° to about 1,850° C. In the second procedure, the mix of magnesia and alumina is prepared and calcined at a temperature of 1,500° ± 200° C for about 1 to 4 hours to form a two phase product of spinel and magnesia doped alumina. The calcined product is then crushed and ground to a particle size of from 1 to 40 μm. Suitable cores are then formed by dispensing sufficient powdered calcined material into a core mold, pressing for compaction thereof and sintering at a temperature of from about 1,600° to about 1,850° C. Such cores, manufactured in either manner, have achieved excellent usage in casting the advanced superalloy NiTaC-13. They easily withstand elevated temperatures of from 1,600° to about 1,800° C for periods up to 30 hours and more.

The resulting NiTaC-13 castings have acceptable surface finishes and the magnesia doped alumina cores were easily removed from the castings by either one of the autoclave KOH or NaOH leaching processes. The KOH and the NaOH had no detrimental effect on the finish or integrity of the superalloy casting.

After the autoclave processing, the casting is removed from the autoclave, washed in water and dried in a warm oven. The casting can now be stored or processed further as required.

I claim as my invention:

1. A sintered core of a ceramic material suitable for use in the casting and directional solidification of advanced superalloys consisting essentially of a sintered magnesia doped alumina material composition wherein the magnesia content is from greater than about 1 mole percent to about 20 mole percent, the microstructure of the sintered magnesia doped alumina is characterized by a matrix comprising an interconnecting network of magnesia doped alumina defining a plurality of interstices in which magnesium aluminate spinel is deposited, and the core material is removable from the solidified casting by autoclave leaching in leaching solutions selected from KOH and NaOH.

2. The core material composition of claim 1 wherein the magnesia content is no greater than about 15 mole percent.

3. The core material composition of claim 2 wherein the magnesia content is at least 5 mole percent.

4. The core material composition of claim 1 wherein the magnesia content is about 5 mole percent.

* * * * *